US011768055B2

(12) United States Patent
Mauricio

(10) Patent No.: US 11,768,055 B2
(45) Date of Patent: Sep. 26, 2023

(54) BALLISTIC DROP AND RANGING SYSTEM FOR A WEAPON

(71) Applicant: Trijicon, Inc., Wixom, MI (US)

(72) Inventor: Jeremiah Mauricio, Tecumseh, MI (US)

(73) Assignee: Trijicon, Inc., Wixom, MI (US)

( * ) Notice: Subject to any disclaimer, the term of this patent is extended or adjusted under 35 U.S.C. 154(b) by 149 days.

(21) Appl. No.: 17/318,383

(22) Filed: May 12, 2021

(65) Prior Publication Data

US 2022/0364827 A1 Nov. 17, 2022

(51) Int. Cl.
*F41G 1/473* (2006.01)
*F41G 1/32* (2006.01)
*F41G 1/38* (2006.01)

(52) U.S. Cl.
CPC ..... *F41G 1/32* (2013.01); *F41G 1/473* (2013.01); *F41G 1/38* (2013.01)

(58) Field of Classification Search
CPC ..... F41G 1/32; F41G 1/473
USPC ..... 33/297
See application file for complete search history.

(56) References Cited

U.S. PATENT DOCUMENTS 4,531,052 A 7/1985 Moore
5,171,933 A 12/1992 Eldering
5,276,554 A 1/1994 Nassivera
6,154,971 A * 12/2000 Perkins ..... F41G 1/467 124/87
7,162,806 B1 * 1/2007 Swiggart ..... G03B 29/00 124/87
7,624,528 B1 12/2009 Bell et al.
7,905,046 B2 3/2011 Smith, III
9,062,961 B2 6/2015 Chen et al.
9,068,795 B2 * 6/2015 Roman ..... F41G 3/06
9,310,165 B2 4/2016 Bell et al.
9,323,061 B2 4/2016 Edwards et al.
9,347,742 B2 * 5/2016 Varshneya ..... F41G 3/165
9,383,166 B2 7/2016 Jahromi
9,389,425 B2 7/2016 Edwards et al.
9,494,787 B1 11/2016 Bagwell
9,784,575 B2 * 10/2017 Senne ..... F41G 1/38
10,502,527 B2 * 12/2019 Kleck ..... F41G 3/06
11,143,508 B2 * 10/2021 Mitchell ..... G01S 19/51
11,221,626 B2 * 1/2022 Kozak ..... G06V 20/13
11,663,828 B1 * 5/2023 Shaw ..... H04N 23/64 348/143

(Continued)

OTHER PUBLICATIONS

Office Action issued in corresponding GB Application No. 2206722.7 dated Nov. 4, 2022 (5 Pages).

*Primary Examiner* — George B Bennett
(74) *Attorney, Agent, or Firm* — Harness, Dickey & Pierce, P.L.C.

(57) ABSTRACT

An optical sight configured to be mounted to a weapon includes a lens assembly, a display, and a controller. The display is configured to display a target animal through the lens assembly. The controller is configured to determine a range from the optical sight to the target animal and display the range on the display. The controller is configured to determine an animal type, a known animal dimension, and a display area for the target animal, where the display area for the target animal is a percentage of the display occupied by the target image. The controller is configured to determine the range from the known animal dimension and the display area for the animal.

20 Claims, 13 Drawing Sheets

(56) References Cited

U.S. PATENT DOCUMENTS

| | | | | |
|---|---|---|---|---|
| 2012/0298750 | A1* | 11/2012 | McCarty | F41G 1/473<br>235/404 |
| 2015/0130950 | A1 | 5/2015 | Bacarella et al. | |
| 2017/0284771 | A1 | 10/2017 | Roman et al. | |
| 2020/0191527 | A1* | 6/2020 | Roman | F41G 3/2605 |
| 2020/0240751 | A1* | 7/2020 | Maryfield | F41G 3/065 |
| 2022/0391629 | A1* | 12/2022 | Lovegrove | G06V 20/20 |
| 2022/0412692 | A1* | 12/2022 | Baumgartner | B64D 17/80 |

* cited by examiner

| | 2.5' Pig | | | 2.75' Pig | | 3' Pig | | |
|---|---|---|---|---|---|---|---|---|
| Range | MOA Size | Display (%) | Sim Distance | MOA Size | Display (%) | Sim Distance | MOA Size | Display (%) |
| 25 | 112-118 | 18-22% | 28-32 | 123-129 | 20-25% | | 135-140 | 22-27% |
| 50 | 55-60 | 8-12% | 57-61 | 61-66 | 9-13% | 18-23 | 66-71 | 10-15% |
| 100 | 26-31 | 4-7% | 111-116 | 29-34 | 4-7% | 38-43 | 32-37 | 5-8% |
| 150 | 17-21 | 2-5% | 166-171 | 19-23 | 2-5% | 84-89 | 20-25 | 3-6% |
| 200 | 12-17 | 1.5-4% | 220-225 | 13-18 | 1.5-4% | 129-134 | 15-20 | 2-4.5% |
| 250 | 9-14 | 1-3.5% | 275-280 | 10-15 | 1-3.5% | 175-180 | 11-16 | 1.5-4% |
| 300 | 7-12 | 0.5-3% | 329-334 | 8-13 | 0.5-3% | 220-225 | 9-14 | 1-3.5% |
| | | | | | | | | |

*Figure 6A*

| Range | Drop (inches) | Drop (MOA) |
|---|---|---|
| 0 | -1.0 to -2.0 | |
| 50 | -0.20 to -0.40 | 0.5 to 0.6 |
| 100 | 0 | 0 |
| 150 | -0.5 to -1.0 | 0.3 to 0.6 |
| 200 | -2.0 to -3.5 | 1.0 to 2.0 |
| 250 | -5.0 to -7.0 | 2.0 to 3.0 |
| 300 | -10.0 to -12.0 | 3.0 to 4.0 |
| 350 | -16.0 to -19.0 | 4.0 to 6.0 |
| 400 | -25.0 to -28.0 | 6.0 to 7.0 |
| 450 | -36.0 to -38.0 | 7.0 to 9.0 |
| 500 | -49.0 to -52.0 | 8.5 to 10.5 |

*Figure 6B*

BALLISTIC DROP AND RANGING SYSTEM FOR A WEAPON

FIELD

The present disclosure relates to an optical sight for a weapon, and, more specifically, to a ballistic drop and ranging system for a weapon.

BACKGROUND

This section provides background information related to the present disclosure which is not necessarily prior art.

Optical sights are often used with firearms such as rifles and/or handguns to allow a user to more clearly see a target and aim the firearm at the target. Conventional optical sights include a series of lenses and/or other optical components that magnify an image and provide a reticle to allow a user to align a magnified target relative to a barrel of the firearm. Optical sights may include one or more adjustment mechanisms that allow for adjustment of a position of the reticle relative to the barrel of the firearm.

Digital optical sights may additionally include a camera that projects the target image on a display for the user. In some applications, the user may digitally input settings for the camera using buttons to change a magnification of the image.

Weapon users often have a hard time estimating distance without a laser range finder. This is especially true in low-light conditions or when using various optics. In particular, because thermal optics are based off temperature, the image generated by the optic appears different and users often struggle to estimate range and drop. Ballistic drop and ranging is important for estimating a target point and controlling the projectile.

SUMMARY

This section provides a general summary of the disclosure, and is not a comprehensive disclosure of its full scope or all of its features.

An example optical sight according to the present disclosure and configured to be mounted to a weapon includes a lens assembly, a display, and a controller. The display is configured to display a target animal through the lens assembly. The controller is configured to determine a range from the optical sight to the target animal and display the range on the display. The controller is configured to determine an animal type, a known animal dimension, and a display area for the target animal, where the display area for the target animal is a percentage of the display occupied by the target image. The controller is configured to determine the range from the known animal dimension and the display area for the animal.

The controller may be configured to prompt a user to input the animal type, a dimension type, and the known animal dimension.

The controller may be configured to determine the animal type by correlating one of a plurality of animal images stored in a memory with the target animal.

The controller may be configured to determine the range by correlating the display area and the known animal dimension with a range stored in a memory.

The controller may be configured to provide a picture-in-picture magnified image within a main screen of the display.

The controller may be configured to determine the display area by providing an outline of the animal image, adjusting the outline of the animal image to fit the target animal, and determining the percentage of the display area of the adjusted outline of the animal image.

The controller may be configured to determine a ballistic drop based on the range.

The controller may be configured to center the display on a primary aiming point when determining the range, and the controller may be configured to center the display on a ballistic drop aiming point after determining the ballistic drop.

The controller may be configured to determine the ballistic drop by correlating the range with one of a plurality of ballistic drops in a table for a specific projectile stored in a memory.

The lens assembly may be a thermal lens assembly.

An example method for determining ballistic drop and range on an optical sight according to the present disclosure includes: displaying, on a display, a target animal as captured through a lens assembly; determining an animal type, a known animal dimension, and a display area for the target animal, the display area for the target animal being a percentage of the display occupied by the target image; determining, by a controller, a range from the optical sight to the target animal based on the known animal dimension and the display area for the animal; and displaying the range on the display.

The method may further include prompting, by the controller, a user to input the animal type, a dimension type, and the known animal dimension.

The method may further include determining, by the controller, the animal type by correlating one of a plurality of animal images stored in a memory with the target animal.

Determining the range may include correlating the display area and the known animal dimension with a range stored in a memory.

The method may further include providing, by the controller, a picture-in-picture magnified image within a main screen of the display.

Determining the display area may include providing an outline of the animal image, prompting the user to adjust the outline of the animal image to fit the target animal, and determining the percentage of the display area of the adjusted outline of the animal image.

Determining the display area may include providing an outline of the animal image, adjusting the outline of the animal image to fit the target animal, and determining the percentage of the display area of the adjusted outline of the animal image.

The method may further include determining, by the controller, a ballistic drop based on the range.

Determining the ballistic drop may include correlating the range with one of a plurality of ballistic drops in a table for a specific projectile stored in a memory.

Determining the ballistic drop may include calculating the ballistic drop from the range, a type of projectile, and a projectile weight.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6A is a table of estimated rages for various sized pigs viewed through the optic of FIG. 1.

FIG. 6B is a table of estimated ballistic drops for various ranges of the optic of FIG. 1.

Corresponding reference numerals indicate corresponding parts throughout the several views of the drawings.

DETAILED DESCRIPTION

Figure 1:
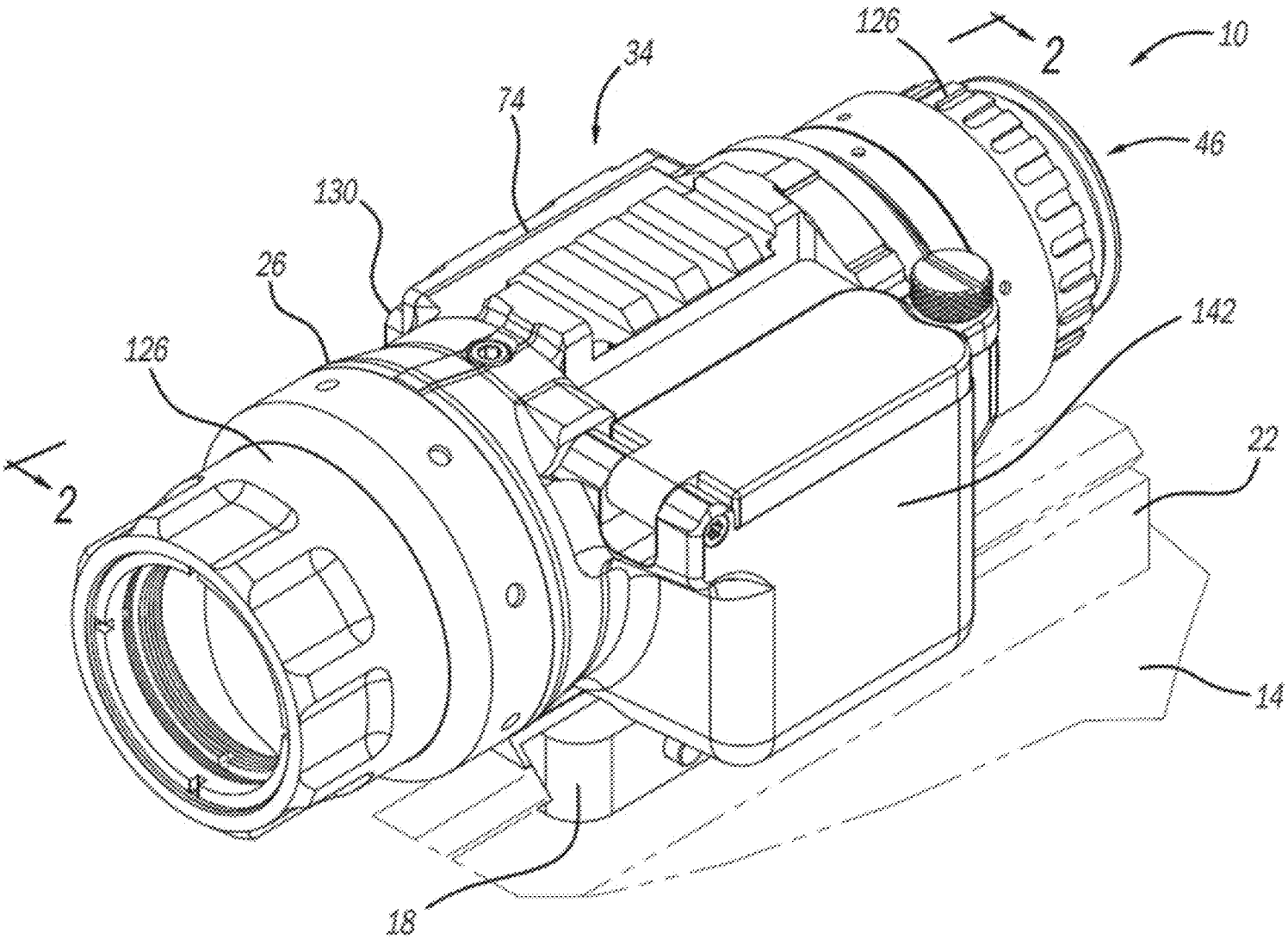
FIG. 1 is a perspective view of an optic according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include processor hardware (shared, dedicated, or group) that executes code and memory hardware (shared, dedicated, or group) that stores code executed by the processor hardware.

The module may include one or more interface circuits. In some examples, the interface circuit(s) may implement wired or wireless interfaces that connect to a local area network (LAN) or a wireless personal area network (WPAN). Examples of a LAN are Institute of Electrical and Electronics Engineers (IEEE) Standard 802.11-2016 (also known as the WIFI wireless networking standard) and IEEE Standard 802.3-2015 (also known as the ETHERNET wired networking standard). Examples of a WPAN are IEEE Standard 802.15.4 (including the ZIGBEE standard from the ZigBee Alliance) and, from the Bluetooth Special Interest Group (SIG), the BLUETOOTH wireless networking standard (including Core Specification versions 3.0, 4.0, 4.1, 4.2, 5.0, and 5.1 from the Bluetooth SIG).

The module may communicate with other modules using the interface circuit(s). Although the module may be depicted in the present disclosure as logically communicating directly with other modules, in various implementations the module may actually communicate via a communications system. The communications system includes physical and/or virtual networking equipment such as hubs, switches, routers, and gateways. In some implementations, the communications system connects to or traverses a wide area network (WAN) such as the Internet. For example, the communications system may include multiple LANs connected to each other over the Internet or point-to-point leased lines using technologies including Multiprotocol Label Switching (MPLS) and virtual private networks (VPNs).

In various implementations, the functionality of the module may be distributed among multiple modules that are connected via the communications system. For example, multiple modules may implement the same functionality distributed by a load balancing system. In a further example, the functionality of the module may be split between a server (also known as remote, or cloud) module and a client (or, user) module. For example, the client module may include a native or web application executing on a client device and in network communication with the server module.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. Such apparatuses and methods may be described as computerized apparatuses and computerized methods. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Swift, Haskell, Go, SQL, R, Lisp, Java®, Fortran, Perl, Pascal, Curl, OCaml, JavaScript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The present disclosure provides a ballistic drop and ranging system for an optical sight for a weapon, and, for example, for a firearm. The system may base a ranging estimate on one of a number of parameters provided by a user and may determine the ballistic drop estimation from the ranging estimation. When accurate, or relatively accurate, information is provided to the optic, the range estimate and ballistic drop estimate is within 5% accuracy of the actual, measured range and ballistic drop up to approximately 300 yards, with a midrange optic. As the optic range increases, the accuracy increases in yardage.

For example, the user may provide the type of animal. A drop-down box may be provided for the user to select the type of animal for a target. For example, the user may select from a boar, a black bear, a brown bear, a moose, a deer, a goose, etc. Alternatively, the ballistic drop and ranging system may identify the general type of animal for the target animal from a pre-programmed library.

For example, the user may provide any known dimension as a parameter for determining the ranging estimate. For example, the user may provide one or more of the following dimensions: vertical thickness of the abdomen, horizontal length of the abdomen, height of the back or stomach from the ground, the full length of the animal, etc. The larger the dimensions the better the estimate. Alternatively, the ballistic drop and ranging system may match known average dimensions for the general type of animal. The average dimensions may be stored with the general type of animal in the pre-programmed library.

The user may then encase the animal with a target box through the optic. A dial may be provided to size the box over the animal. Alternatively, the ballistic drop and ranging system may automatically match a box over the animal target. The ballistic drop and ranging system may then correlate the user-provided parameters and the target box with a stored table and output the estimated range to the user. The ballistic drop and ranging system may determine the estimated drop from the estimated range and the specifications for the projectile.

Now referring to FIG. 1, an optical sight 10 according to the present disclosure may be configured to be mounted on a weapon 14. For example, the optical sight 10 may be a thermal optic, a digital optic, a night-vision optic, etc. For example, the weapon 14 may be a firearm, a crossbow, or any other device for firing a projectile.

The optical sight 10 may be selectively mounted on the weapon 14 by a sight mount 18. For example, the sight mount 18 may be integral with a body 22 of the weapon 14 or may be removably attached to the weapon 14 by a fastening system (for example, a fastener such as a bolt, screw, or clamp, etc.). For example, the sight mount 18 may be integral with a housing 26 of the optical sight 10 or may be removably attached to the housing 26 by a fastening system (for example, a fastener such as a bolt, screw, or clamp, etc.).

Figure 2:
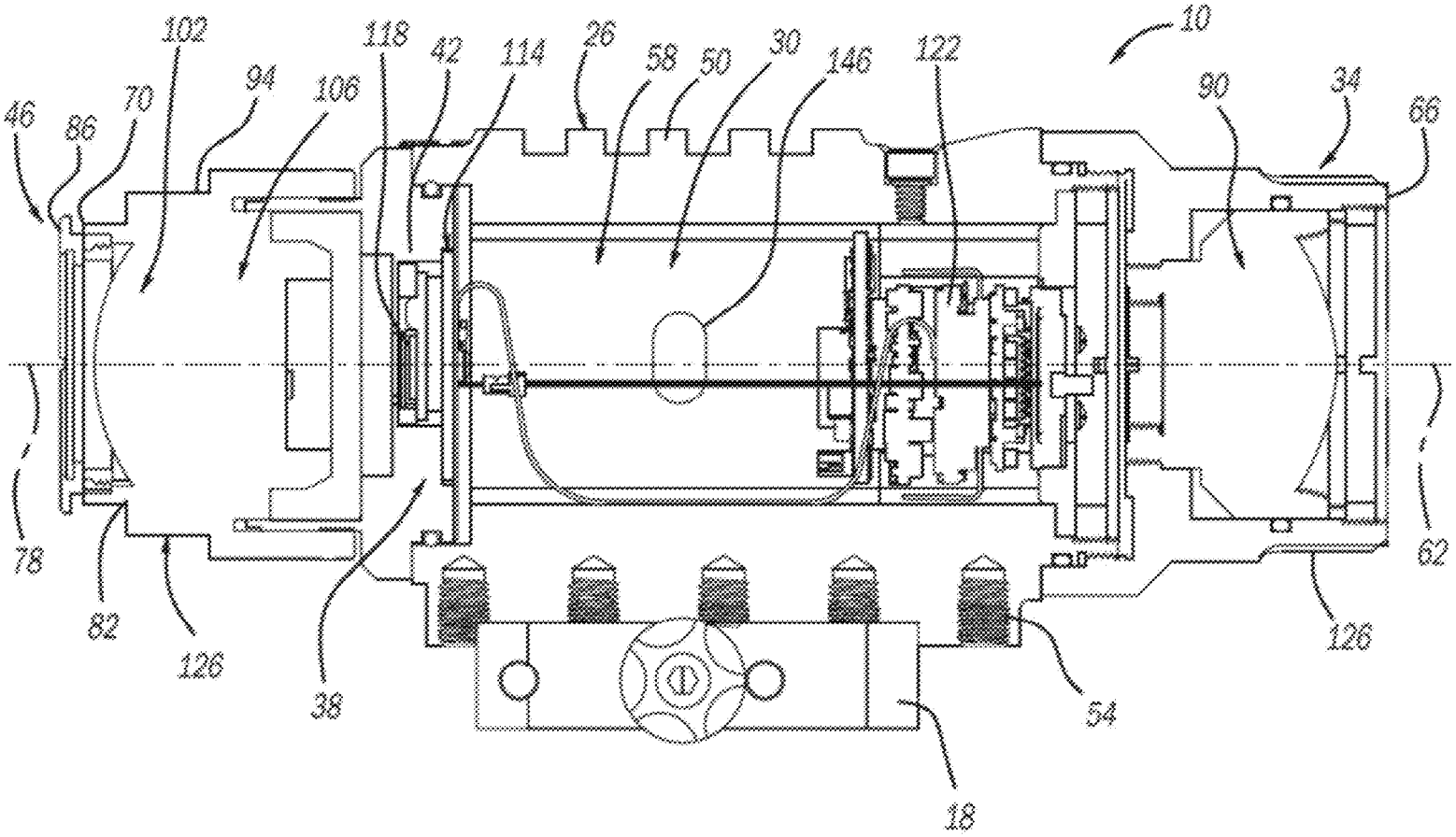
FIG. 2 is a cross-sectional view of the optic of FIG. 1 cut along the line 2-2.

Now referring to FIG. 2, the optical sight 10 may include an optics train 30, an adjustment system 34, a ballistic drop and ranging system 38, an imaging system 42, and an eyepiece 46 supported by the housing 26.

The optics train 30 cooperates with the imaging system 42 to provide a magnified image, a thermal image, a night vision image, or a combination of these, while the adjustment system 34 positions the optics train 30 and/or the imaging system 42 relative to the housing 26 to properly align the optics train 30 and/or the imaging system 42 relative to the weapon 14. In one configuration, the optics train 30 and/or imaging system 42 magnifies a target to a size substantially equal to six times the viewed size of the target (i.e., 6× magnification). The imaging system 42 may also cooperate with the optics train 30 to provide a thermal image of a target. The optics train 30 may display a reticle (not shown) for use in properly aligning the optical sight 10 with a target.

The housing 26 includes a main body 50 attached to the eyepiece 46. The main body 50 includes a series of threaded bores 54 to attach the housing 26 to the weapon 14 and an inner cavity 58 having a longitudinal axis 62. A first end 66 of the main body 50 includes a substantially circular shape and is in communication with the inner cavity 58 of the housing 26. A second end 70 is disposed generally on an opposite side of the main body 50 from the first end 66 and similarly includes a generally circular cross section.

The main body 50 supports the adjustment system 34 and may include at least one aperture 74 (FIG. 1) that operably receives a portion of the adjustment system 34 therein.

The eyepiece 46 is matingly received by the main body 50 and may be attached thereto. The eyepiece 46 includes a longitudinal axis 78 that is co-axially aligned with the longitudinal axis 62 of the main body 50 when the eyepiece 46 is assembled to the main body 50. The eyepiece 46 includes a first end 82 attached to the main body 50 and a second end 86 disposed on an opposite end of the eyepiece 46 from the first end 82. For example the first end 82 of the eyepiece 46 may be received (for example, threadably engaged) within the second end 70 of the main body 50.

The optics train 30 is shown to include an objective lens system 90 and an ocular lens system 94. The objective lens system 90 is a telephoto objective and is disposed generally proximate to the first end 66 of the main body 50. For example, the objective lens system 90 may include a convex-plano doublet lens having a substantially doublet-convex lens and a substantially concave-convex lens secured together by a suitable adhesive and a convex-plano singlet lens. Alternatively, the objective lens system 90 may include any suitable combination of lenses. The objective lens system 90 may be secured within the first end 66 of the main body 50 via a threaded retainer ring, an adhesive, a combination thereof, or another suitable fastener to position and attach the objective lens system 90 relative to the main body 50 of the housing 46.

The ocular lens system 94 is disposed generally on an opposite end of the optical sight 10 from the objective lens system 90 and may include an eyepiece lens 102, which may be of a bi-convex singlet or substantially doublet-convex type lens, and a doublet ocular lens 106. Hereinafter, the eyepiece lens 102 will be described as doublet-convex eyepiece lens 102. The doublet ocular lens 106 may include a substantially doublet-convex lens and a substantially doublet-concave lens secured together by a suitable adhesive. Alternatively, the ocular lens system 94 may include any suitable combination of lenses. The ocular lens system 94 may be held in a desired position relative to the eyepiece 46 of the housing 26 via one or more threaded retainer rings, adhesive, a combination of these, or another suitable fastener.

Regardless of the particular construction of the objective lens system 90 and the ocular lens system 94, the imaging system 42 is disposed within the main body 50 of the housing 26 generally between the objective lens system 90 and the ocular lens system 94. The imaging system 42 may include a processor or controller 114 and a display system 118 which are in communication with a camera 122.

The camera 122 may be disposed along the optics train 30 between the objective lens system 90 and the ocular lens system 94. The camera 122 may be positioned adjacent the objective lens system 90. The camera 122 may capture digital video images of a target scene that are processed and provided to the user. The target scene may be a scene captured through an opening in the first end 66 of the housing 26. The images may be continuously captured by the camera 122 and streamed to the user through the display system 118 (described below).

For example, light from the target scene may enter the opening in the first end 66 of the housing 26 and may be captured by the camera 122. The images may then be processed and/or provided to the display system 118. For example, the images may be zoomed images of the target scene provided by optical zoom and/or digital zoom features of the camera 122 and/or the processor 114.

The camera 122 may be one of various types of cameras. The camera may include a camera sensor, or may be a camera sensor, that detects various wavelengths of light. For example, the camera 122 may capture images of visible light, infrared spectrum wavelengths, thermal spectrum wavelengths, hyperspectral wavelengths, and/or another type of camera as may be appropriate in applications. Thus, high resolution digital images, infrared images, thermal images, and/or other types of images of any desired spectra may be captured.

The adjustment system 34 may be configured to position a portion of the image relative to the housing 26 to properly align a reticle pattern (not shown) relative to the firearm. The adjustment system 34 may include an adjustment ring 126, one or more buttons 130 (FIG. 1), a combination of these, or another suitable adjustment mechanism, to adjust the image relative to the housing 26. The adjustment system 34 may adjust, change, or alter, for example, clarity, pixels, contrast, magnification adjustment, etc. The adjustment system 34 may collectively adjust an alignment of a reticle pattern.

The adjustment system 34 may move the alignment of the reticle pattern horizontally. For example, rotation of the adjustment ring 126, selection of the buttons 130, etc., may be detected by a sensor positioned adjacent the adjustment system 34 in the housing 26. The sensor may communicate with the processor 114 to move the horizontal position of the reticle pattern.

The adjustment system 34 may move the alignment of the reticle pattern vertically. For example, rotation of the adjustment ring 126, selection of the buttons 130, etc., may be detected by a sensor positioned adjacent the adjustment system 34 in the housing 26. The sensor may communicate with the processor 114 to move the vertical position of the reticle pattern.

The adjustment system 34 may increase or decrease a light intensity of the reticle or change a color of the reticle. For example, rotation of the adjustment ring 126, selection of the buttons 130, etc., may be detected by a sensor positioned adjacent the adjustment system 34 in the housing 26. The sensor may communicate with the processor 114 to brighten the reticle, dim the reticle, or change a color of the reticle displayed to the user.

The adjustment system 34 may increase or decrease a magnification of the image. For example, rotation of the adjustment ring 126, selection of the buttons 130, etc., may be detected by a sensor positioned adjacent the adjustment system 34 in the housing 26. The sensor may communicate with the processor 114 and/or camera 122 to increase or decrease the image displayed to the user.

The housing 26 may also define a secondary interior space 142 (FIG. 1) housing a power source 146 (FIG. 2). The power source 146 may be a power storage unit, for example, a battery. The power source 146 may supply power to the camera 122, the processor 114, the display 118, and/or other features of optical sight 10.

Figure 3:
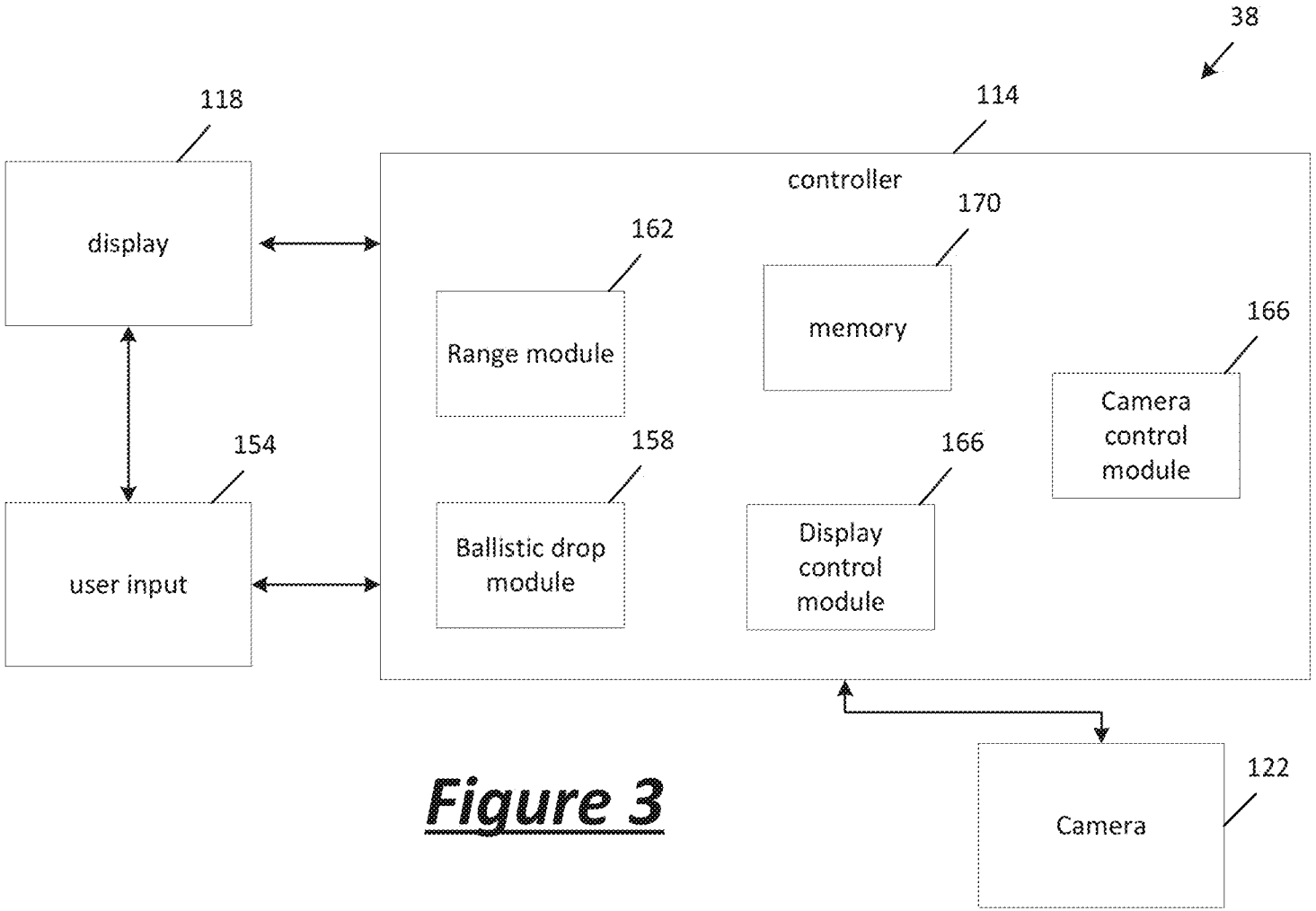
FIG. 3 is a functional block diagram of a controller for the optic of FIG. 1.

Now referring to FIG. 3, the ballistic drop and ranging system 38 may cooperate with the camera 122, the display system 118, the controller 114, and a user input 154. The controller 114 may be in communication with the display system 118, the camera 122, and the user input 154. The controller 114 and user input 154 works with the display system 118 of the imaging system 42 to request information and provide range and ballistic drop data to a user.

The display system 118 may include a digital display configured to provide a target image to the user. For example, the display system 118 may be in communication with the camera 122 through the controller 114. Light from the target scene may enter the first end 66 of the housing 26 and may be captured by the camera 122. The camera 122 may capture images of visible light, infrared spectrum wavelengths, thermal spectrum wavelengths, hyperspectral wavelengths, and/or another type of camera as may be appropriate in applications. Thus, high resolution digital images, infrared images, thermal images, and/or other types of images of any desired spectra may be captured.

Different types of display systems 118 may be used. For example, in various embodiments, the display system 118 may be implemented as a liquid crystal display (LCD), a Digital Light Processing (DLP) display (e.g., which may provide brighter images than conventional LCD implementations in certain embodiments), an organic light emitting diode (OLED) display, a plasma display, a cathode ray tube (CRT) display, or another type of display as may be appropriate in particular applications. For example, the display may project an image including the target object from the camera 122 and a reticle, (for example, a cross-hair or red dot).

The user input 154 may be a digital input and may include buttons (such as buttons 130) configured to be manipulated by the user to provide information and selections. The user input 154 may be in communication with the display system 118 and the controller 114. The user may be able to select options through drop down menus pictured on the display system 118 to provide information.

The controller 114 may include a ballistic drop module 158, a range module 162, and a display control module 166. The range module 162 may receive information from the user input 154. For example, the range module 162 may receive an animal type, an estimated dimension, and a dimension type from the user input. The animal type and dimension type may be selected from a drop-down menu displayed on the display system 118. For example, the animal type may be selected from a boar, a black bear, a brown bear, a moose, a deer, a duck, a pheasant, a dove, a goose, etc. For example, the dimension type may be selected from vertical thickness of the abdomen, horizontal length of the abdomen, height of the back or stomach from the ground, height from ground to shoulder, the full length of the animal, etc. Larger dimensions may provide a better range estimate.

The user may provide the estimated dimension in a fill-in box on the display 118, using either number buttons or arrow buttons. Alternatively, the estimated dimension may be provided in a drop-down box by selecting numbers to populate the estimated dimension. For example only, the user may provide dimensions for a boar between 2.5-3.5 feet from ground to shoulder.

Alternatively, the range module 162 may identify the general type of animal for the target animal from a library saved within a memory 170 within the controller 114. For example, the library may be a pre-programmed library and may include images for various animals. The user may aim crosshairs on the optical lenses to overlay the target animal. The range module 162 may identify a stored image that most resembles the target animal. For example, the range module 162 may match predetermined points on the stored image with the target animal to identify the general type of animal. The stored image having the most matches with the target animal is determined to be the animal type.

Alternatively, the range module 162 may match known average dimensions for the general type of animal. The average dimensions may be stored with the general type of animal in the pre-programmed library within the memory 170. For example, if the range module 162 identifies the target animal as a boar, the range module 162 may use an average dimension for the boar. For example only, the average dimension for the boar may be within a range of 2.5-3.5 feet from ground to shoulder.

The range module 162 may determine an estimated range based on the user inputs and/or animal and size determinations. Based on the animal type, the range module 162 may communicate the animal type to the display control module 166 which provides crosshairs with an animal outline of the animal type on the display 118. Additionally referring to FIG. 4, for example only, the display 118 may provide an animal outline 174 of a boar when a boar is indicated as the animal type.

Figure 4:
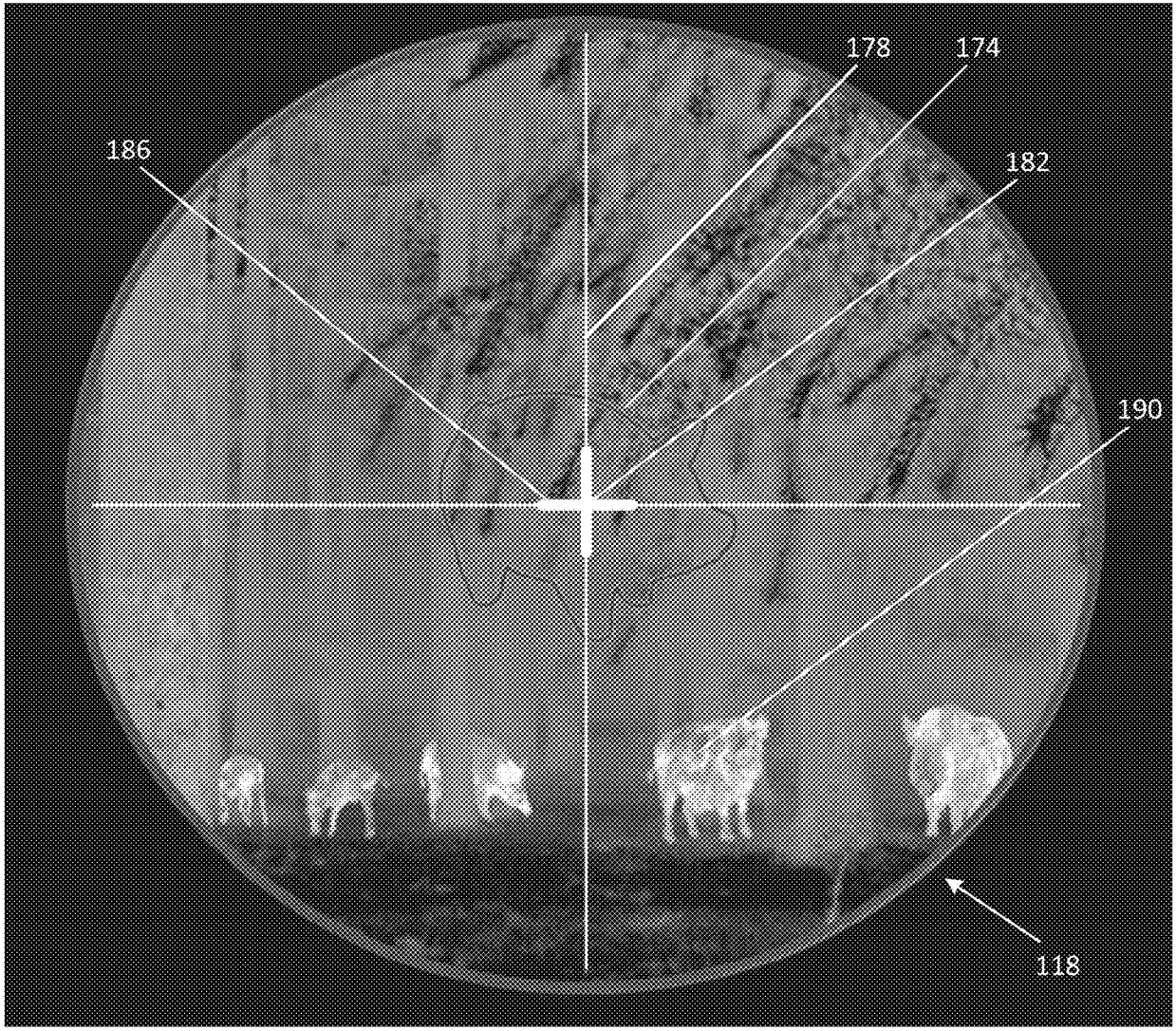
FIG. 4 is a picture of a display of the optic of FIG. 1.

In FIG. 4, the animal outline 174 of the boar is sized to simulate 100 yards. Thin crosshairs 178 indicate a center 182 of the display 118. The thin crosshairs 178 may not be visible during use. Alternatively, the thin crosshairs 178 may be visible. The aiming point crosshairs 186 indicate the aiming location. As seen at the 100 yard simulation, the aiming point crosshairs 186 overlap with the intersection of the thin cross hairs 178, indicating that the 100 yard aiming point is at the center 182 of the display 118.

The range module 162 may prompt the user to align the animal outline 174 with a target animal 190. For example, the range module 162 may prompt the display control module 166 to illuminate a message to the user to align the animal outline 174 with the target animal on the display 118.

Figure 5:
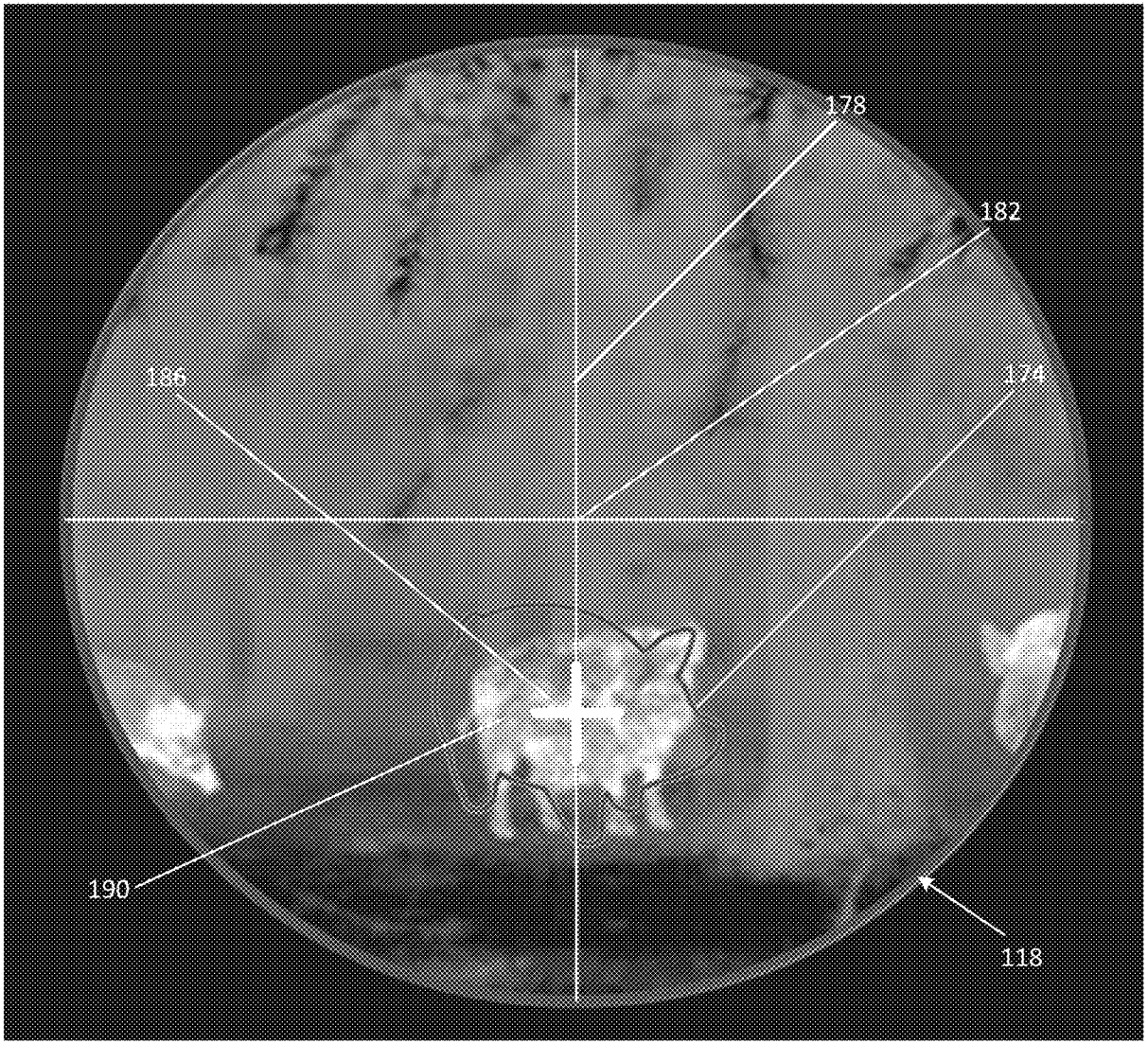
FIG. 5 is a picture of another display of the optic of FIG. 1.

Referring additionally to FIG. 5, once the animal outline 174 is aligned with the target animal 190, the user may be prompted to increase or decrease a size of the animal outline 174 to correlate with a perimeter of the target animal 190. For example, the range module 162 may prompt the display control module 166 to illuminate a message to the user to adjust the size of the animal outline 174 on the display 118. The user may be able to adjust the size through the user input 154. For example, the user may manipulate up and down arrow buttons to adjust the size of the animal outline 174. Alternatively, the user may manipulate a toggle switch or rotating knob to adjust the size of the animal outline 174.

In FIG. 5, the animal outline 174 of the boar is sized to simulate 200 yards. The thin crosshairs 178 indicate the center 182 of the display 118. The thin crosshairs 178 may not be visible during use. Alternatively, the thin crosshairs 178 may be visible. The aiming point crosshairs 186 and animal outline 174 indicate the aiming location. As seen at the 200 yard simulation, the aiming point crosshairs 186 are at a position below the intersection of the thin cross hairs 178, indicating that the 200 yard aiming point is below the center 182 of the display 118. In FIG. 5, digital zoom is increasing the reference size of the target animal 190, the animal outline 174, and aiming point crosshairs 186. The user may activate the digital zoom using the user input 154, as described below.

The range module 162 may determine an estimated range based on the type of animal, the estimated dimension of the animal, and the size of the animal outline on the display 118. For example, the field of view (for example, the display 118 in FIGS. 4 and 5) of the optic 10 provides angular dimensions for each pixel as well as all of the pixels. The linear dimension of the animal provided by the user is considered a known dimension. When the known dimension is overlaid on the target animal 190, the range module 162 estimates the range based on the angular dimensions for the pixels. Referring additionally to FIG. 6A, for example, for a 35 millimeter equivalent focal length (35 mm EFL) lens, when the known dimension of a boar is 3 feet from ground to shoulder, the Minute of Angle (MOA) size is within a range of 20-25 MOA, and the animal outline is within a range of 3-6% of the display, the range may be approximately 150 yards. The ranges in FIG. 6A may be example numbers only and may be different for different optics 10 or different lenses. The ranges stored in the memory 170 for each specific optic 10 may be based on calculations and confirmed by testing.

The ballistic drop module 158 may determine an estimated ballistic drop for the target animal based on the estimated range. For example, the estimated ballistic drop may take into consideration the type and weight of the projectile. The various ballistic drops for range segments may be stored in the library in the memory 170. The ballistic drops for the range segments may be determined based on test data. Alternatively, the ballistic drops for the range segments may be determined based on calculations considering the force of the projectile, the mass of the projectile, the distance traveled, and gravity. The calculated ballistic drops may be validated by test data. Referring additionally to FIG. 6B, for example, ballistic drops may be stored for ranges every 50 yards from 0 yards to 500 yards. For example, for a 0.223 full metal jacket round with 55 grain bullet weight, the estimated ballistic drop at a range of 150 yards may be within a range of −0.5 to −1.0 inches.

The ballistic drop module 158 may determine an estimated drop on the reticle (for example, an MOA reticle) that correlates with the estimated ballistic drop in inches. The correlation between the estimated drop on the reticle and the estimated ballistic drop in inches may be stored in the library in the memory 170. The estimated drop on the reticle may be determined based on calculations considering dimensions and/or lens focal length. The correlated estimated drop may be stored for each range segment having an estimated ballistic drop. Referring to FIG. 6B, for example, correlated drops for the reticle may be stored for ranges every 50 yards from 0 yards to 500 yards. For example, the estimated drop on the reticle at the range of 150 yards may be within a range of 0.30 to 0.60.

The ballistic drop module 158 may communicate with the display control module 166 to illuminate a target aiming point based on the estimated drop on the reticle. The ballistic drop module 158 may additionally communicate with the display control module to display the estimated ballistic drop in inches.

The display control module 166 may control the display to illuminate the reticle, the animal outline, the range, the drop, etc., alone or in combination. The animal outline 174 may be illuminated when the range module 162 is determining the range. The animal outline 174 may be removed from the display after the range is determined and displayed. The range may be displayed in a location on the perimeter of the display 118 in numerical form. Alternatively, the range may be displayed in the center of the display 118. The drop may be displayed in numerical or dot form. The numerical drop value may be displayed in a location on a perimeter of the display 118. Alternatively, the numerical drop value may be displayed in a center of the display 118. The dot drop value may be displayed on the reticle with reference to the main crosshairs.

The display control module 166 may activate a digital zoom through user input 154. Alternatively, the display control module 166 may automatically activate the digital zoom during the range determination. For example, in either case, the display control module 166 may be in communication with a camera control module 194 in the controller 114. The camera control module 194 may adjust a magnification of the camera 122 to increase the magnification of the image processed by the controller 114 for viewing on the display 118. For example, the camera control module 194 may adjust a magnification of the camera 122 to increase the magnification of the image 5×, 8×, 10×, or any number of times.

The zoom may center on an aiming point 198. For example, referring additionally to FIGS. 7A and 7B, the user may move the aiming point 198 from an original position aligned on an intersection 202 of a primary vertical crosshair 206 and a primary horizontal crosshair 210 to a second position on the display 118. For example, the aiming point 198 may be moved through the user input 154 (buttons, joystick, etc.).

Figure 7A:
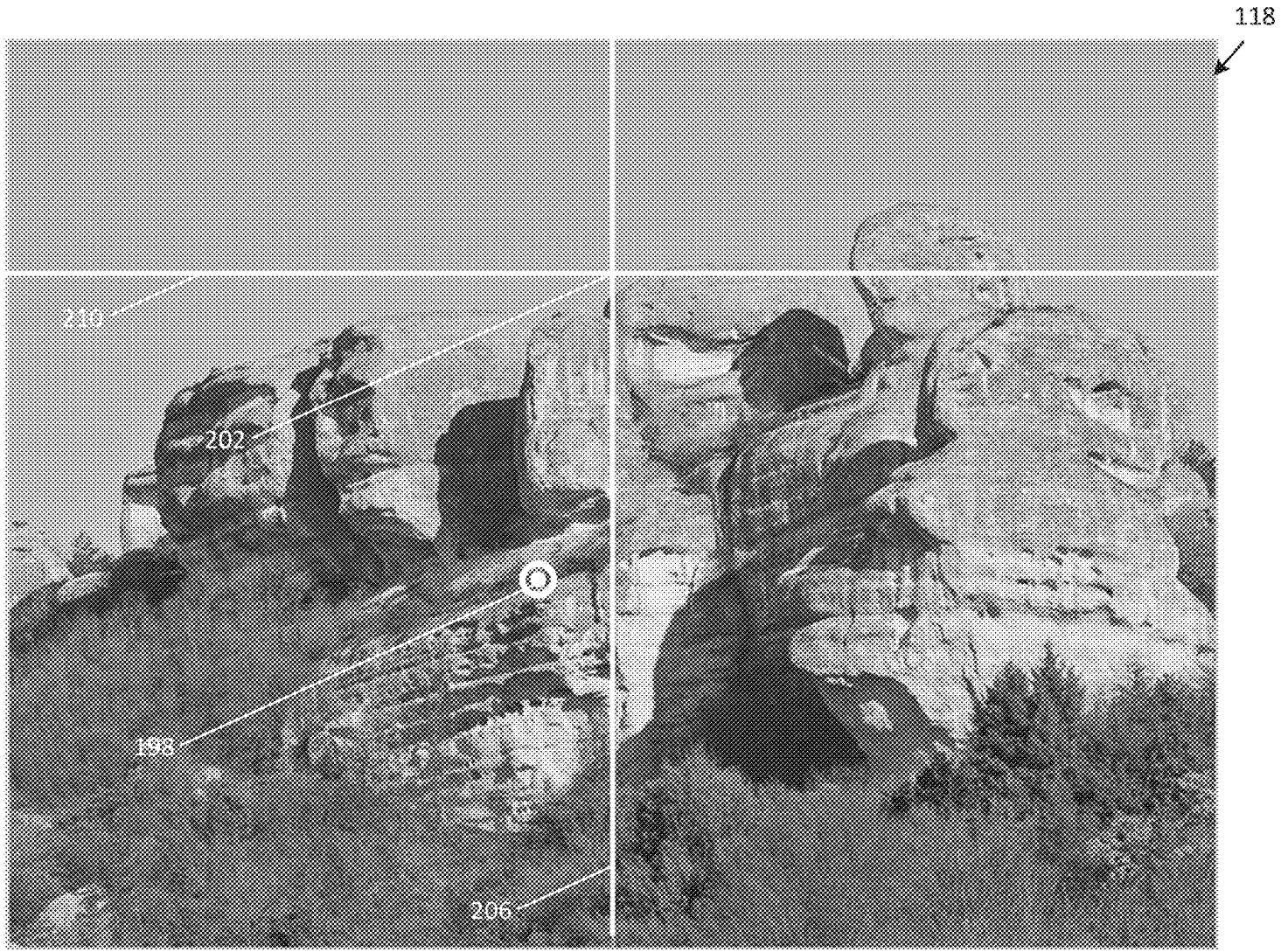
FIG. 7A is a picture of a display of the optic of FIG. 1.
Figure 7B:
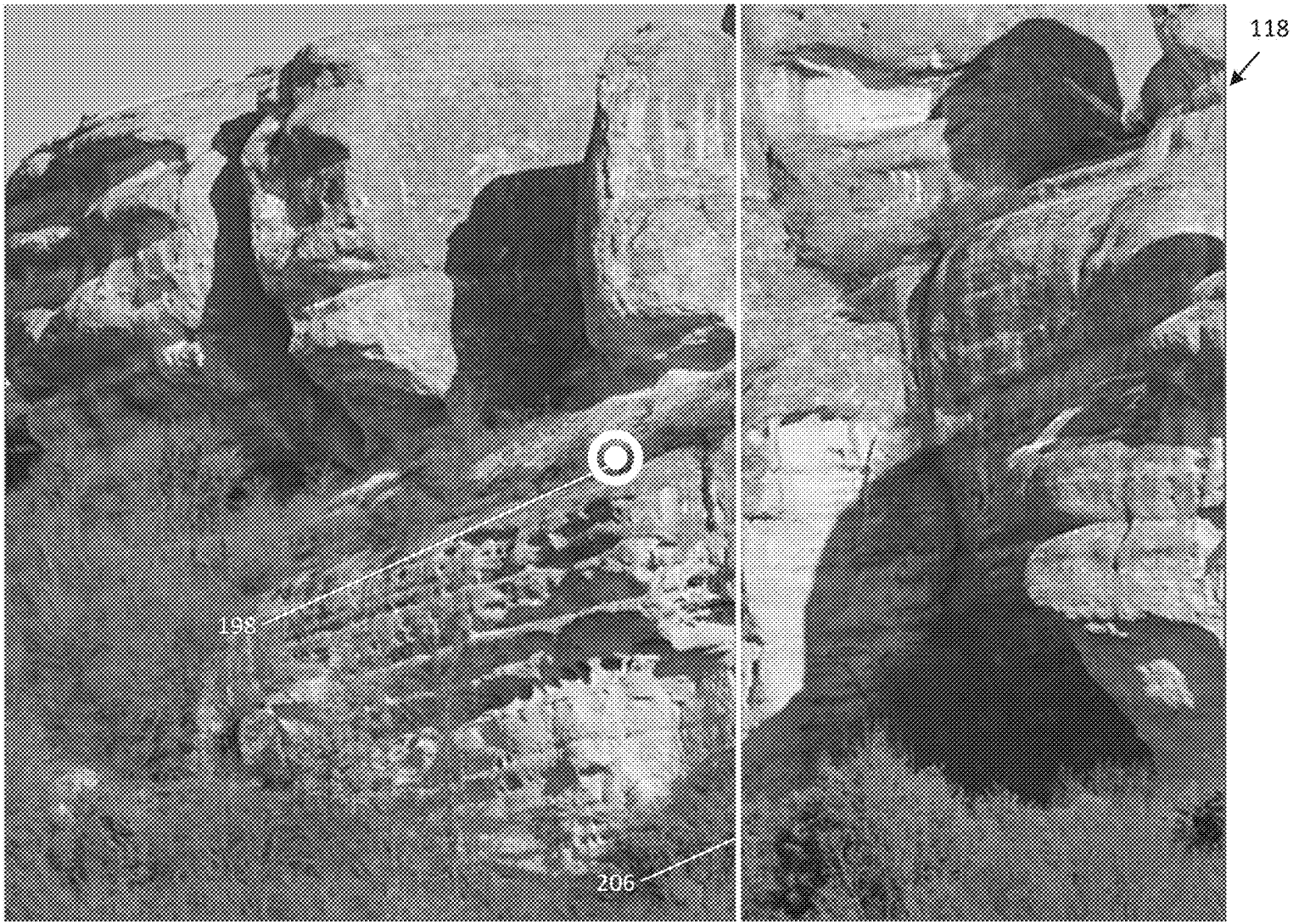
FIG. 7B is a picture of another display of the optic of FIG. 1.

An additional user input 154 may be selected to activate the zoom feature. For example, the user may press a zoom button, the range button, another button, a toggle switch, etc., to activate the zoom. Upon receipt of the signal from the user input 154, the camera control module 194 may adjust a magnification of the camera 122 to zoom the image, with the zoomed image centered on the aiming point 198, as shown in FIG. 7B.

Figure 8:
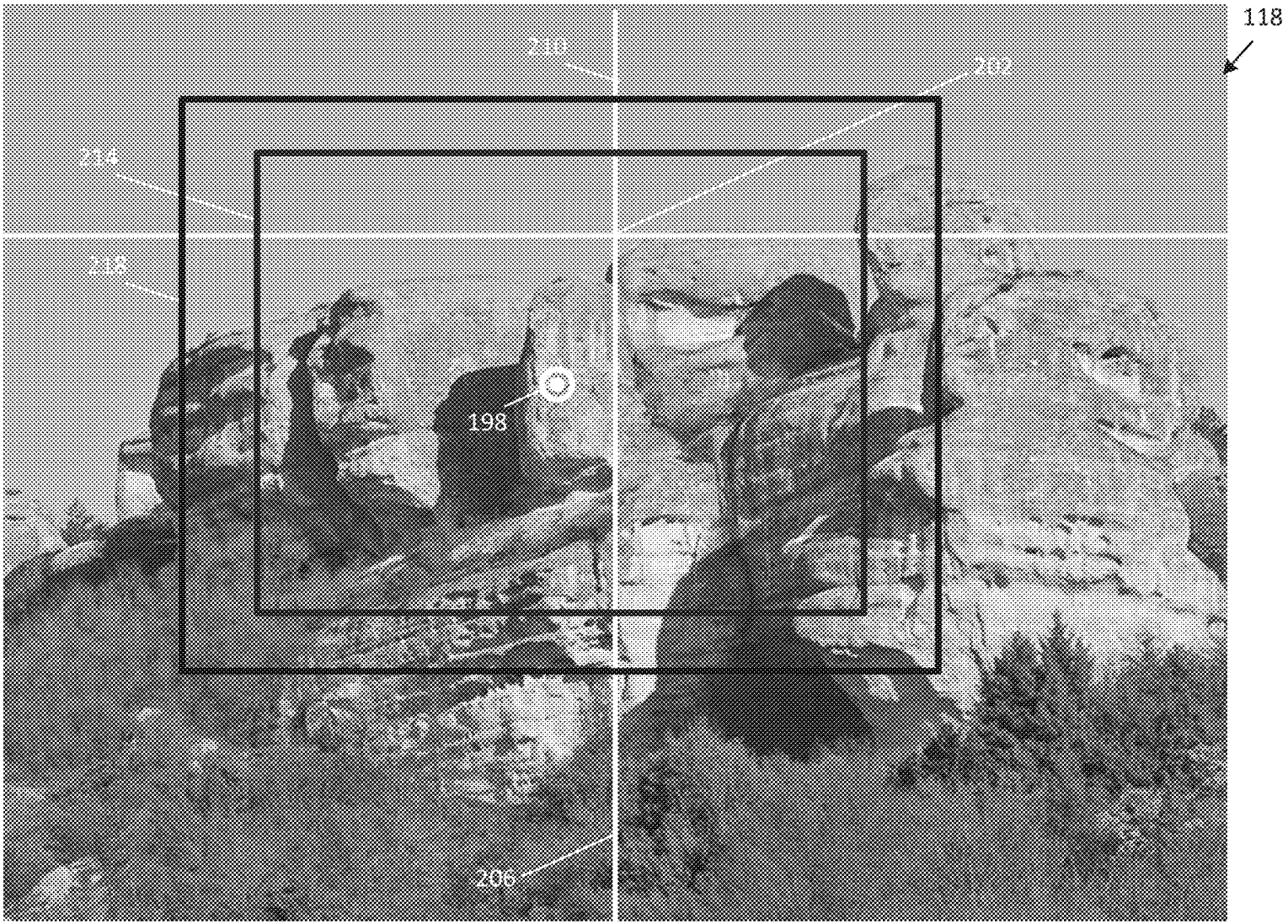
FIG. 8 is a picture of another display of the optic of FIG. 1.

Alternatively, the user may select between a plurality of boxes representing different zoom options for the camera 122. As illustrated in FIG. 8, an inner box 214 may represent a field of view for a first zoom option and an outer box 218 may represent a field of view for a second, different, zoom option. The first zoom option may have higher magnification than the second zoom option. For example, the first zoom option may be 10× digital zoom and the second zoom option may be 8× digital zoom. While the inner box 214 and outer bod 218 are illustrated and described, it is understood that the present disclosure is not limited to two boxes, but may include any number of boxes having different zoom options. As previously discussed, each zoom option centers on the aiming point 198. The user may select between the boxes using the user input 154.

Referring to FIG. 3, the display control module 166 may display the reticle and information on a single display screen or may provide a picture-in-picture image. Referring additionally to FIGS. 7A, 7B, and 8, the single display screen may transition from a zoomed view to a re-centered view. For example, when aligning the crosshairs or primary aiming point 202, for example, at a long range (for example, 600 meters or more), the magnification of the optic may increase such that the estimated ballistic drop, when determined, is at a position outside of the field of view of the display 118. To view the estimated ballistic drop at aiming point 198, the display 118 may be re-centered on the aiming point 198 (and the primary aiming point 202 may be outside of the field of view of the display 118). Thus, the primary aiming point 202 may be centered in the display 118 to collect the ranging data and determine the estimated range and ballistic drop (see FIG. 7A), and the display 118 may be re-centered around the aiming point 198 to display the ballistic drop point (see FIG. 7B).

Figure 9:
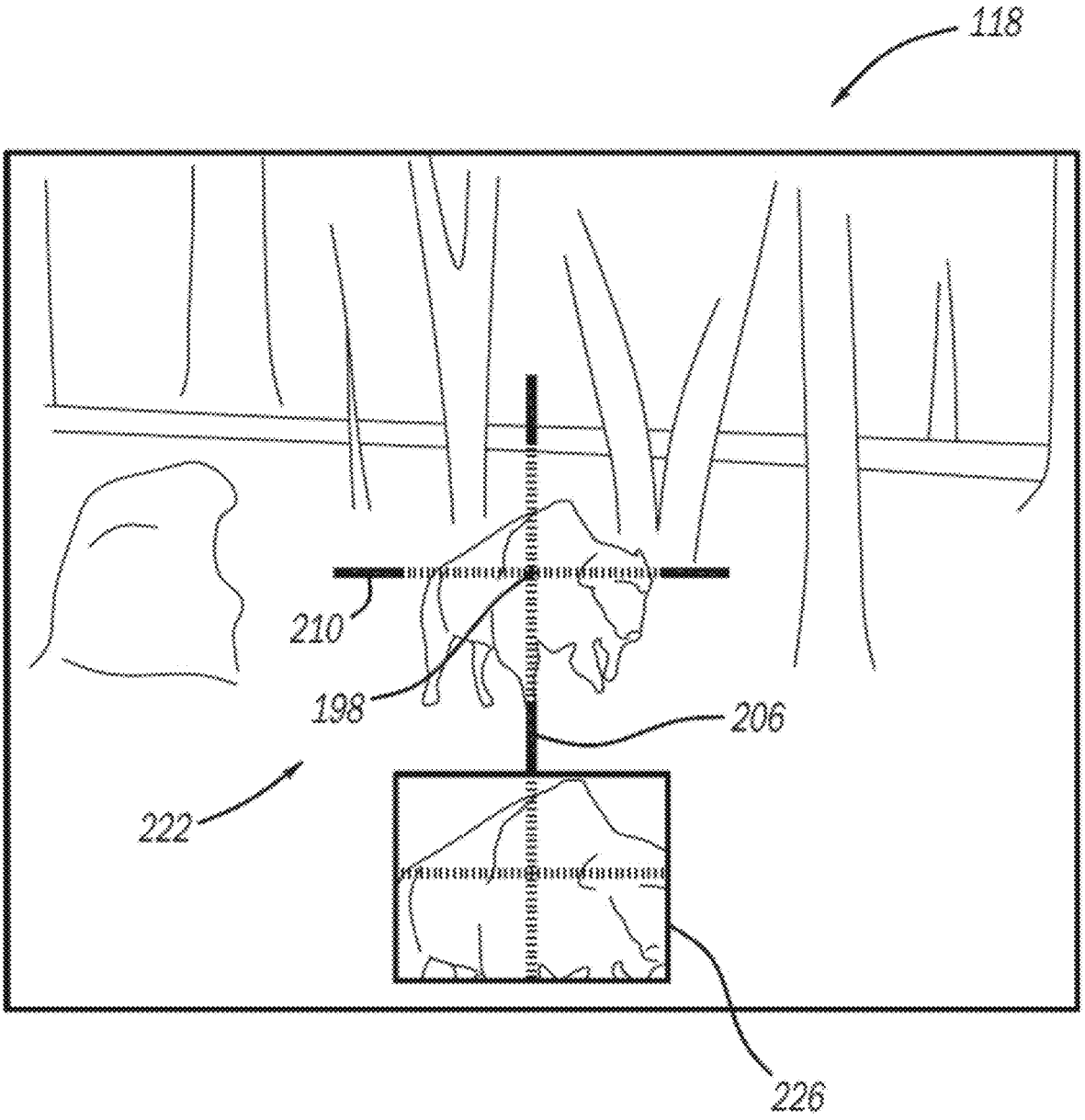
FIG. 9 is a schematic view of another display of the optic of FIG. 1.

Referring additionally to FIG. 9, the picture-in-picture image on the display 118 may provide a main screen 222 and a magnified portion 226 of the main screen 222 provided overlaying the main screen 222. The magnified portion 226 may be displayed at any location on the main screen 222. For example, as shown in FIG. 9, the magnified portion 226 may be displayed on the bottom of the main screen 222.

The user may select the portion of the main screen 222 that is included in the magnified portion 226. For example, using the user input 154, the user may select the intersection 202 of the primary crosshairs 206, 210 as the portion of the main screen 222 for the magnified portion 226. The magnified portion 226 is then centered on the intersection 202 (i.e., primary aiming point). Alternatively, using the user input 154, the user may select the aiming point (or a dot drop point) 198 as the portion of the main screen 222 for the magnified portion 226. The magnified portion is then centered on the aiming point 198.

The user may select the magnification for the magnified portion through the user input 154. For example, the user input 154 may include buttons, toggle switches, or knobs that adjust the magnification for the magnified portion 226. For example, the magnification of the magnified portion 226 may be adjusted within the full magnification range of the optic.

The magnified portion 226 may have the same pixel count as the main screen 222. For example, a size of the pixels on the magnified portion 226 may be the same as a size of the pixels on the main screen 222. The magnified portion 226, therefore, may be a clearer image than if the pixels from the main screen 222 were just increased in size for the zoom.

The magnified portion 226 may have a different reticle image than a reticle image of the main screen 222. For example, the main screen 222 may include a crosshair reticle, while the magnified portion 226 includes a dot reticle. Alternatively, the magnified portion 226 and the main screen 222 may have the same reticle image. For example, the reticle on the magnified portion 226 and the reticle on the main screen 222 may both be crosshair reticles, dot reticles, etc.

Figure 10:
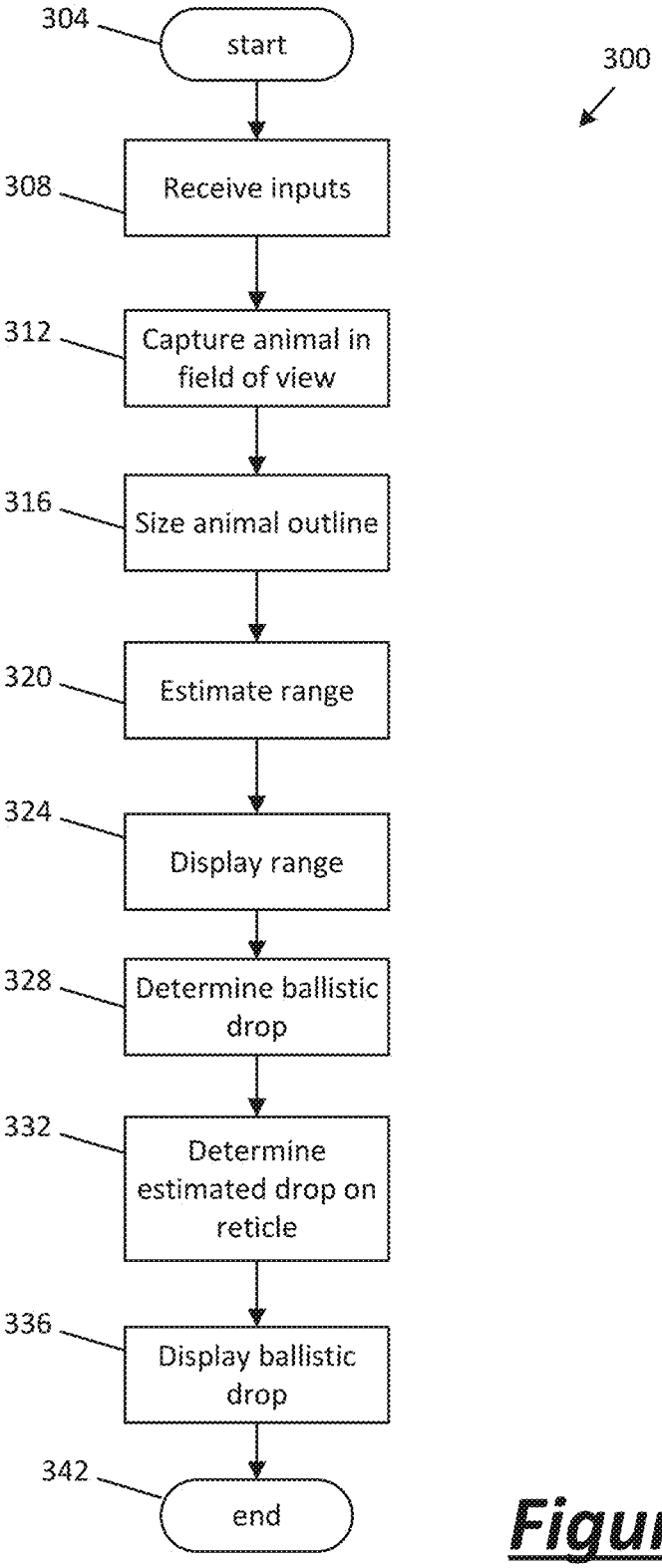
FIG. 10 is a flow chart for a method of determining an estimated range and ballistic drop for the optic of FIG. 1.

Now referring to FIG. 10, a flow chart for a range and ballistic drop estimation method 300 is illustrated. Method 300 begins at 304. At 308, the user inputs the various parameters. For example, the controller 114 may prompt the user to enter the parameters on the display 118. The user may input the parameters using the user inputs 154. For example, the user inputs 154 may be buttons, toggle switches, knobs, or joysticks. For example, the various parameters may include an animal type, an animal dimension, a size estimate, or a combination of these.

The user may enter the animal type. For example, the user may select an animal type on the display 118. The selection may be a box selection, a drop-down menu, a type-in box, etc. The animal type may be one of a boar, a black bear, a brown bear, a moose, a deer, a goose, etc.

The user may enter the animal dimension type. For example, the user may select the dimension type on the display 118. The selection may be a box selection, a drop-down menu, a type-in box, etc. The dimension type may be one of a vertical thickness of the abdomen, a horizontal length of the abdomen, a height of the back or stomach from the ground, a height of the shoulder from the ground, a full length of the animal, etc.

The user may enter the size estimate for the dimension type. For example, user may provide the estimated dimension in a fill-in box on the digital display 118, using either number buttons or arrow buttons. Alternatively, the estimated dimension may be provided in a drop-down box by selecting numbers to populate the estimated dimension. For example only, the user may provide dimensions for a boar between 2.5-3.5 feet from ground to shoulder.

Alternatively, one or more of the animal type, the dimension type, and the size estimate may be determined by the controller 114. For example, one or more of the method steps in FIG. 11, described below, may be implemented to determine the animal type, the dimension type, the size estimate, or a combination of these.

At 312, the animal may be captured in the display 118, or the field of view, of the optic 10. For example, the controller 114 may prompt the user to align the reticle with the animal in the field of view by displaying a message on the display 118. The reticle may be a crosshair reticle or dot reticle. The controller 114 may illuminate an outline of the animal centered on the reticle on the display 118. Additionally referring to FIG. 4, for example only, the display 118 may provide an outline 174 of a boar when a boar is indicated as the animal type.

The user may have the option of magnifying the animal outline 174 and target animal 190 in a picture-in-picture format. The user may adjust the zoom to increase the magnification of the target animal 190 in a magnified portion 226 overlaying the main screen 222. The magnified portion 226 may assist the user in aligning the target animal 190 within the animal outline 174.

At 316, the animal outline 174 may be sized to fit the target animal 190 in the display 118. For example, the controller 114 may prompt the user to increase or decrease a size of the animal outline 174 to correlate with a perimeter of the target animal 190 through a display message. The user may be able to adjust the animal outline 174 size through the user input 154. For example, the user may manipulate up and down arrow buttons to adjust the size of the animal outline 174. Alternatively, the user may manipulate a toggle switch or rotating knob to adjust the size of the animal outline 174.

At 320, an estimated range may be determined. For example, the controller 114 may determine the estimated range based on the type of animal, the estimated dimension of the animal, and the size of the animal outline on the display 118. For example, the controller 114 may provide an estimated range that correlates with look-up values on a table saved in the memory 170. The table may be a pre-programmed table, populated with ranges that have been calculated and validated by testing. Referring additionally to FIG. 6A, for example, for a 35 millimeter equivalent focal length (35 mm EFL) lens, when the known dimension of a boar is 3 feet from ground to shoulder, the MOA size is within a range of 20-25 MOA, the animal outline is within a range of 3-6% of the display, the range may be approximately 150 yards.

At 324, the estimated range is displayed. For example, the controller 114 may display the range on the display 118 in numeric form.

At 328, the estimated ballistic drop may be determined. For example, the controller 114 may determine the estimated ballistic drop for the target animal 190 based on the estimated range. For example, the controller 114 may include a ballistic calculator that calculates the drop based on the range, the type of projectile, and the weight of the projectile. Alternatively, for example, the controller 114 may provide an estimated ballistic drop that correlates with look-up values on a table saved in the memory 170. The table may be a pre-programmed table, populated with ballistic drops for each range that have been calculated and validated by testing. For example, the estimated ballistic drop may take into consideration the type and weight of the projectile. Referring to FIG. 6B, for example, ballistic drops may be stored for ranges every 25-50 yards from 0 yards to 500 yards. For example, for a 0.223 full metal jacket round with 55 grain bullet weight, the estimated ballistic drop at a range of 150 yards may be within a range of −0.5 to −1.0 inches.

At 332, the estimated drop on the reticle may be determined. The controller 114 may determine the estimated drop on the reticle (for example, an MOA reticle) that correlates with the estimated ballistic drop in inches. For example, the controller 114 may calculate the drop on the reticle by converting the estimated drop in inches to MOA. Alternatively, the correlation between the estimated drop on the reticle and the estimated ballistic drop in inches may be stored as a table in the memory 170. The correlated estimated drop may be stored for each range segment having an estimated ballistic drop. Referring to FIG. 6B, for example, correlated drops for the reticle may be stored for ranges every 25-50 yards from 0 yards to 500 yards. For example, the estimated drop on the reticle at the range of 150 yards may be within a range of 0.30 to 0.60.

At 336, the estimated drop on the reticle may be displayed for the user. For example, the controller 114 may display one or both of the estimated ballistic drop and the estimated drop on the reticle. The controller 114 may display the estimated ballistic drop in numerical form on a perimeter of the reticle. Alternatively, or in addition, the controller 114 may display the estimated drop on the reticle as a secondary aiming point or dot reticle (for example, aiming point 186) on the display 118.

The controller 114 may display the range and ballistic drop data as a picture-in-picture, with the magnified portion 226 and main screen 222. The estimated drop may be displayed as the secondary aiming point 186 on the magnified portion 226 along with the primary aiming point 198, and the estimated ballistic drop and estimated range may be displayed in numerical form on the main screen 222.

Method 300 ends at 342.

Figure 11:
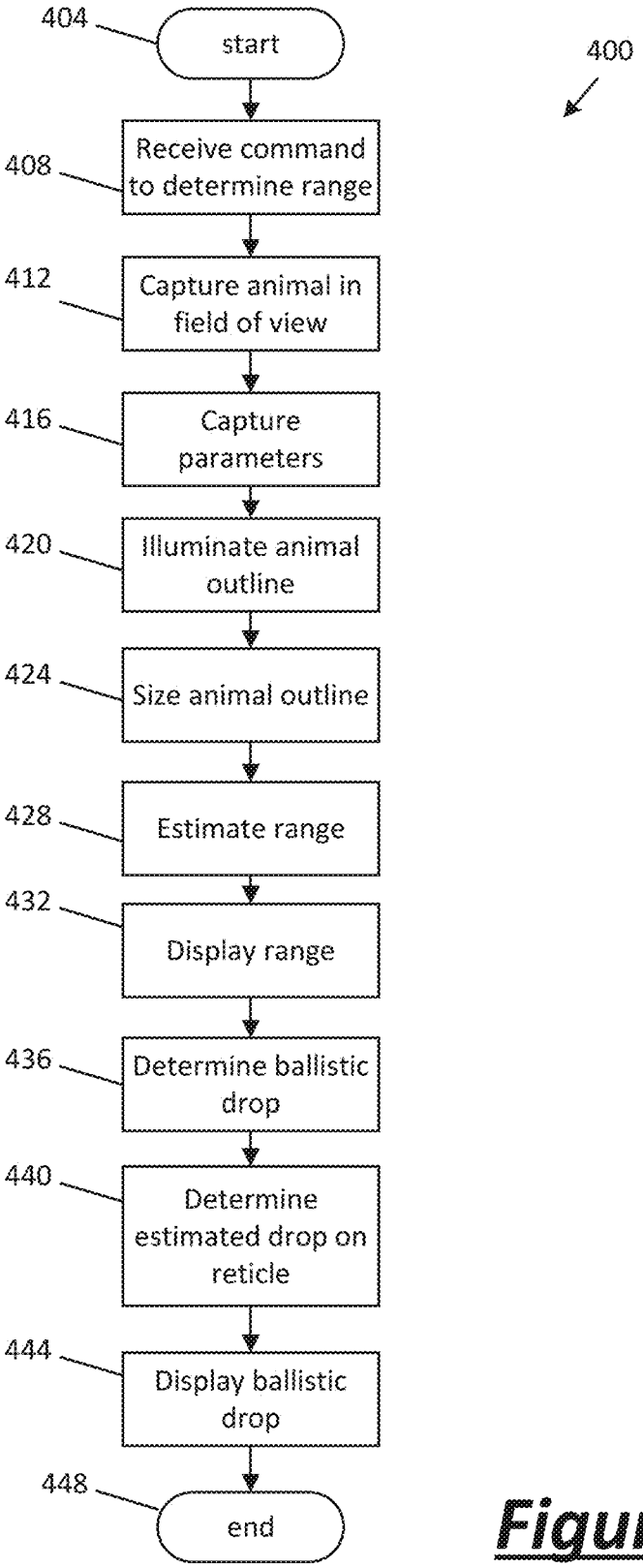
FIG. 11 is a flow chart for another method of determining an estimated range and ballistic drop for the optic of FIG. 1.

Now referring to FIG. 11, a flow chart for another range and ballistic drop estimation method 400 is illustrated. Method 400 begins at 404. At 408, a command to determine a range may be received from a user. For example, the user may input the command using the user inputs 154. For example, the user inputs 154 may be buttons, toggle switches, knobs, or joysticks.

At 412, the user may be prompted to align the target animal 190 with the reticle 186 in the field of view of the display 118. For example, the controller 114 may illuminate a message on the display 118 prompting the user to align the target animal 190 within the display 118. The reticle 186 may be a crosshair reticle (FIGS. 4 and 5) or dot reticle (FIGS. 7A, 7B, and 8).

At 416, parameters may be determined. For example, the controller 114 may determine an animal type, an animal dimension type, and a size. For example, the animal type may be one of a boar, a black bear, a brown bear, a moose, a deer, a goose, etc. The controller 114 may access a library of stored images of the animal types. The controller 114 may correlate predetermined points on the stored images with corresponding points on the target animal 190 in the display 118. For example, the image with the most matched points is selected as the animal type.

For example, the dimension type may be one of a vertical thickness of the abdomen, a horizontal length of the abdomen, a height of the back or stomach from the ground, a height of the shoulder from the ground, a full length of the animal, etc. The controller 114 may access a library of stored dimension types and sizes for the selected animal type. The sizes may be average sizes for the particular animal type.

Alternatively, the user may be prompted to indicate (for example, in a drop down box, a fill-in box, or buttons) whether the target animal is a juvenile or an adult. Alternatively, the library of stored images may include images for both a juvenile and an adult of each animal type and may correlate the images with the target animal 190 in the display 118 to determine animal type and whether it is an adult or juvenile. For example only, the controller 114 may select dimensions for a boar between 2.5-3.5 feet from ground to shoulder.

At 420, an animal outline 174 for the animal type may be illuminated on the display 118. For example, the controller 114 may prompt the user to align the animal outline 174 with the animal in the display 118 by displaying a message on the display 118. Additionally referring to FIG. 4, for example only, the display 118 may provide an outline of a boar when a boar is indicated as the animal type.

The user may have the option of magnifying the animal outline and target animal in a picture-in-picture format. The user may adjust the zoom to increase the magnification of the target animal 190 in a magnified portion 226 overlaying the main screen 222. The magnified portion 226 may assist the user in aligning the target animal 190 within the animal outline 174.

At 424, the animal outline may be sized to fit the target animal in the display. For example, the controller 114 may increase or decrease a size of the animal outline 174 to correlate with a perimeter of the target animal 190. For example, the controller 114 may increase or decrease the size of the animal outline 174 to correlate predetermined points on the animal outline 174 with corresponding points on the target animal 190.

At 428, an estimated range may be determined. For example, the controller 114 may determine the estimated range based on the type of animal, the estimated dimension of the animal, and the size of the animal outline on the display. For example, the controller 114 may provide an estimated range that correlates with look-up values on a table saved in the memory 170. The table may be a pre-programmed table, populated with ranges that have been calculated and validated by testing. Referring additionally to FIG. 6A, for example, for a 35 millimeter equivalent focal length (35 mm EFL) lens, when the known dimension of a boar is 3 feet from ground to shoulder, the MOA size is within a range of 20-25 MOA, the animal outline is within a range of 3-6% of the display, the range may be approximately 150 yards.

At 432, the estimated range is displayed. For example, the controller 114 may display the range on the display 118 in numeric form.

At 436, the estimated ballistic drop may be determined. For example, the controller 114 may determine the estimated ballistic drop for the target animal based on the estimated range. For example, the controller 114 may include a ballistic calculator that calculates the drop based on the range, the type of projectile, and the weight of the projectile. Alternatively, for example, the controller 114 may provide an estimated ballistic drop that correlates with look-up values on a table saved in the memory 170. The table may be a pre-programmed table, populated with ballistic drops for each range that have been calculated and validated by testing. For example, the estimated ballistic drop may take into consideration the type and weight of the projectile. Referring to FIG. 6B, for example, ballistic drops may be stored for ranges every 50 yards from 0 yards to 500 yards. For example, for a 0.223 full metal jacket round with 55 grain bullet weight, the estimated ballistic drop at a range of 150 yards may be within a range of −0.5 to −1.0 inches.

At 440, the estimated drop on the reticle may be determined. The controller 114 may determine the estimated drop on the reticle (for example, an MOA reticle) that correlates with the estimated ballistic drop in inches. For example, the controller 114 may calculate the drop on the reticle by converting the estimated drop in inches to MOA. Alternatively, the correlation between the estimated drop on the reticle and the estimated ballistic drop in inches may be stored as a table in the memory 170. The correlated estimated drop may be stored for each range segment having an estimated ballistic drop. Referring to FIG. 6B, for example, correlated drops for the reticle may be stored for ranges every 50 yards from 0 yards to 500 yards. For example, the estimated drop on the reticle at the range of 150 yards may be within a range of 0.30 to 0.60.

At 444, the estimated drop on the reticle may be displayed for the user. For example, the controller 114 may display one or both of the estimated ballistic drop and the estimated drop on the reticle. The controller 114 may display the estimated ballistic drop in numerical form on a perimeter of the reticle. Alternatively, or in addition, the controller 114 may display the estimated drop on the reticle as a secondary aiming point 186 or dot reticle on the display 118.

The controller 114 may display the range and ballistic drop data as a picture-in-picture, with a magnified portion 226 and main screen 222. The estimated drop may be displayed as the secondary aiming point 186 on the magnified portion 226 along with the primary aiming point 198, and the estimated ballistic drop and estimated range may be displayed in numerical form on the main screen 222.

Method 400 ends at 448.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An optical sight configured to be mounted to a weapon, the optical sight comprising:

a lens assembly;

a display configured to display a target animal through the lens assembly; and a controller configured to determine a range from the optical sight to the target animal and display the range on the display, wherein the controller is configured to determine an animal type, a known animal dimension, and a display area for the target animal, the display area for the target animal being a percentage of the display occupied by the target image, and wherein the controller is configured to determine the range from the known animal dimension and the display area for the animal.

2. The optical sight of claim 1, wherein the controller is configured to prompt a user to input the animal type, a dimension type, and the known animal dimension.

3. The optical sight of claim 1, wherein the controller is configured to determine the animal type by correlating one of a plurality of animal images stored in a memory with the target animal.

4. The optical sight of claim 1, wherein the controller is configured to determine the range by correlating the display area and the known animal dimension with a range stored in a memory.

5. The optical sight of claim 1, wherein the controller is configured to provide a picture-in-picture magnified image within a main screen of the display.

6. The optical sight of claim 1, wherein the controller is configured to determine the display area by providing an outline of the animal image, adjusting the outline of the animal image to fit the target animal, and determining the percentage of the display area of the adjusted outline of the animal image.

7. The optical sight of claim 1, wherein the controller is configured to determine a ballistic drop based on the range.

8. The optical sight of claim 7, wherein the controller is configured to center the display on a primary aiming point when determining the range, and the controller is configured to center the display on a ballistic drop aiming point after determining the ballistic drop.

9. The optical sight of claim 8, wherein the controller is configured to determine the ballistic drop by correlating the range with one of a plurality of ballistic drops in a table for a specific projectile stored in a memory.

10. The optical sight of claim 1, wherein the lens assembly is a thermal lens assembly.

11. A method for determining ballistic drop and range on an optical sight, the method comprising:

displaying, on a display, a target animal as captured through a lens assembly;

determining an animal type, a known animal dimension, and a display area for the target animal, the display area for the target animal being a percentage of the display occupied by the target image;

determining, by a controller, a range from the optical sight to the target animal based on the known animal dimension and the display area for the animal; and displaying the range on the display.

12. The method of claim 11, further comprising prompting, by the controller, a user to input the animal type, a dimension type, and the known animal dimension.

13. The method of claim 11, further comprising determining, by the controller, the animal type by correlating one of a plurality of animal images stored in a memory with the target animal.

14. The method of claim 11, wherein determining the range includes correlating the display area and the known animal dimension with a range stored in a memory.

15. The method of claim 11, further comprising providing, by the controller, a picture-in-picture magnified image within a main screen of the display.

16. The method of claim 11, wherein determining the display area includes providing an outline of the animal image, prompting the user to adjust the outline of the animal image to fit the target animal, and determining the percentage of the display area of the adjusted outline of the animal image.

17. The method of claim 11, wherein determining the display area includes providing an outline of the animal image, adjusting the outline of the animal image to fit the target animal, and determining the percentage of the display area of the adjusted outline of the animal image.

18. The method of claim 11, further comprising determining, by the controller, a ballistic drop based on the range.

19. The method of claim 18, wherein the determining the ballistic drop includes correlating the range with one of a plurality of ballistic drops in a table for a specific projectile stored in a memory.

20. The method of claim 18, wherein the determining the ballistic drop includes calculating the ballistic drop from the range, a type of projectile, and a projectile weight.

* * * * *